US006591843B1

(12) United States Patent
Langohr

(10) Patent No.: US 6,591,843 B1
(45) Date of Patent: Jul. 15, 2003

(54) HAIR CLIP FOR HAIRSTYLING

(76) Inventor: Patrick Langohr, Rue de Dison, 15, B-4800 Verviers (BE)

( * ) Notice: Subject to any disclaimer, the term of this patent is extended or adjusted under 35 U.S.C. 154(b) by 0 days.

(21) Appl. No.: 09/868,371

(22) PCT Filed: Dec. 17, 1999

(86) PCT No.: PCT/BE99/00165

§ 371 (c)(1),
(2), (4) Date: Aug. 27, 2001

(87) PCT Pub. No.: WO00/36948

PCT Pub. Date: Jun. 29, 2000

(30) Foreign Application Priority Data

Dec. 18, 1998 (EP) ..... 98870275

(51) Int. Cl.[7] ..... A45D 8/20; A45D 8/22; A45D 8/00

(52) U.S. Cl. ..... 132/277; 132/278; 132/279; 132/276

(58) Field of Search ..... 132/277, 276, 132/278, 279, 275, 282, 281, 284; D28/39, 40, 41, 42; 24/507, 521, 510, 509

(56) References Cited

U.S. PATENT DOCUMENTS

| | | | | | |
|---|---|---|---|---|---|
| 959,712 | A | * | 5/1910 | Burke | 132/277 |
| 1,576,991 | A | * | 3/1926 | O'neal | 132/277 |
| 2,030,603 | A | * | 2/1936 | McLaughlin | 132/277 |
| 2,133,145 | A | | 10/1938 | Jones | |
| 2,643,658 | A | * | 6/1953 | Koke | 132/277 |
| 2,797,693 | A | * | 7/1957 | Bugge | 132/277 |
| 3,183,915 | A | | 5/1965 | Bolinger | |
| 3,236,246 | A | * | 2/1966 | Culligan | 132/277 |
| 3,250,282 | A | | 5/1966 | Thatcher | |
| 3,568,687 | A | | 3/1971 | Ciccone | |
| 3,841,340 | A | * | 10/1974 | Solomon | 132/277 |
| 3,983,887 | A | * | 10/1976 | Chan | 132/277 |
| 4,976,277 | A | | 12/1990 | Yasuda | |
| 5,758,672 | A | * | 6/1998 | Chou | 132/275 |

FOREIGN PATENT DOCUMENTS

| | | |
|---|---|---|
| EP | 516564 | 12/1992 |
| FR | 770805 | 9/1934 |
| FR | 1317575 | 1/1963 |
| FR | 1489446 | 7/1967 |
| GB | 793909 | 4/1958 |
| GB | 1013720 | 12/1965 |

* cited by examiner

*Primary Examiner*—John J. Wilson
*Assistant Examiner*—Robyn Kieu Doan
(74) *Attorney, Agent, or Firm*—Knobbe Martens Olson & Bear, LLP

(57) ABSTRACT

The present invention is directed to a hair clip for hairdressing. The hair clip comprises at least three prongs each formed by a squeezing part or blade, and an end part, which acts as a lever mechanism for spacing the corresponding blades in pairs.

13 Claims, 3 Drawing Sheets

HAIR CLIP FOR HAIRSTYLING

CROSS-REFERENCE TO RELATED APPLICATIONS

This application is the U.S. National Phase under 35 U.S.C. § 371 of PCT application WO 00/36948 filed on Dec. 17, 1999, which claims priority to European Application Serial Number 98870275.9 filed on Dec. 18, 1998, the disclosures of which are incorporated herein by reference in their entireties.

FIELD OF THE INVENTION

The present invention relates to a hair clip for use in keeping the hair in place during hairstyling. More particularly, the invention relates to clips which serve to shape and keep locks of hair in high or flat curls when carrying out hair setting or permanent-waving operations.

DESCRIPTION OF THE RELATED ART

During hair setting, and most particularly during the treatment known as permanent-waving, the hairstylist uses different means to roll up the hair and keep it in a rolled-up position during the treatment.

After the treatment, the accessories used are, of course, removed and the hair is left with waves or curls that are more or less long-lasting depending on the position in which it was set during the treatment and depending on the fixing techniques which were used.

Originally, rollers or curlers were used to set the rolled-up shape during the treatment.

However, this arrangement of a fairly large number of curlers or rollers is generally not desired due to the bulkiness and weight of the rollers or curlers, even if they are made of a light material, such as synthetic materials.

Furthermore, the use of these curlers or rollers entails a series of drawbacks, such as, in addition to the bulk and weight, an unsightly effect of alignment of the successive curls, a limited diameter of the curls set by the diameter of the curlers, and hair tension which may cause deterioration as a result of the hair being rolled up tightly on the curler during the treatment.

To overcome these drawbacks, and in particular to achieve a "bouffant" structure of the hair without an alignment effect and without the treatment causing tight curling of the hair, it has been suggested to use clips which allow the hair to be prepared for treatment with greater freedom, in particular as regards the arrangement of the rolled-up locks, both to avoid the alignment effect and to avoid very tight rolling-up.

By using clips of this type, the hairstylist forms a series of curls by rolling up locks of hair, either according to a fixed diameter or by selecting a variable diameter, but, preferably, avoiding alignments that are made virtually inevitable by the technique with curlers or rollers.

The hair clips thus allow it to fix the rolling of a lock of hair in a well-defined position chosen by the hairstylist, in contrast with curlers and rollers. Fixing with clips allows finer locks to be taken with a variable rolling diameter, an individual direction and virtually non-existent lines of separation, while at the same time avoiding excessive tension on the hair.

In practice, however, despite the intrinsic advantages of fixing clips when compared with curlers and rollers, the technique of rolling up the lock with the clip, prior to fixing, is very complicated and requires a dexterity which many stylists do not have or, at any rate, requires a relatively long time in order to obtain aesthetically satisfactory effects.

SUMMARY OF THE INVENTION

The invention aims to simplify the rolling-up prior to fixing the locks of hair, by using clips that have been improved compared with conventional clips, and the invention thus also aims to simplify hairstyling techniques based on the use of the described clips.

SUMMARY OF THE STATE OF THE ART

The various forms of conventionally known hairstyling clips are in the form of a device with two arms, defined herein as blades, articulated relative to a transverse articulation axle. The arms are arranged so that two parts of each arm can be separated from each other or brought together in a position of substantially total contact. The arms are brought together or separated by using the two parts of the arm as levers.

Clips of this type are disclosed in particular in the following documents: GB Patent Application No. 793, 909; FR Patent Application No. 1,489,446; FR Patent Application No. 1,317,575; GB Patent Application No. 1,013,720; U.S. Pat. No. 3,250,282; and U.S. Pat. No. 2,133,145, incorporated herein by reference.

These documents disclose specific forms for the constituent components of the clips which may be considered according to the present invention, without, however, the invention being limited to the specific practical details disclosed in these documents.

Document FR-770 805 discloses a clip whose "jaws" do not correspond to the specific shape considered by the present invention, but which provides an advantageous technical solution as regards the design of the spring.

The articulation of the arms on the transverse axle is conventionally achieved by various elastic means such as a spring consisting of a helical elastic metal wire, wound around the transverse articulation axle, a first end of the metal wire extending radially from the axle and coming to bear under the first opening lever and the second end of the metal wire extending radially from the axle and coming to bear under the second opening lever.

Document EP 0 516 564 A1 discloses a clip of the same type as that in the preceding document, with another type of spring.

Other means such as springs consisting of a U-shaped elastic blade whose arms come to bear under the opening levers to separate them from each other are possible.

Elastic means in the form of an open metal ring whose cross section is round or flat etc. are also known.

The function of the spring conventionally is to keep the opening levers apart so that the blades constituting the other end of the articulated arm are brought into contact so as to grip the hair.

Many specific forms of blades have been suggested, such as pointed blades, blades consisting of two-pronged or three-pronged forks, with or without insertion of cross braces, blades having teeth on their edges, etc.

The use of these clips involves the hairstylist forming curls by rolling a lock of hair into a curl, optionally with a twist, and then keeping the curl of hair rolled up using the clip.

A first risk in the course of this operation is that of "biting" the end of the hair. In any case, this operation is relatively intricate since it involves manually forming the curls by manipulating the hair lock by lock in order then to hold it in curls in the desired position using the clip.

Finally, some hair clips whose function is purely decorative and which are not intended for hair setting are known (U.S. Pat. No. 4,976,277 and U.S. Pat. No. 3,183,915).

According to the present invention, a hair clip for hairstyling is proposed, characterized in that it is composed of at least three arms. The arms comprise a gripping part, defined herein as a blade. One end of the arm serves as a control lever for separating corresponding blades in pairs.

Various embodiments for the clip are possible.

Various embodiments for the said clip are possible. According to a first embodiment, a first (outer) arm is articulated relative to a second neighbouring arm on an axle which is different from the axle which provides the articulation of this second arm relative to the following third arm, and so on, if there are more than three arms. In other words, the articulation is carried out in pairs.

According to another embodiment, the various arms are articulated about a common axle.

One configuration based on a virtual axle and the deformability of a bridge linking the control levers in pairs is also possible.

In the various embodiments, one or more springs of different types may be considered, the function of which is to hold the blade of the first arm on the blade of the second arm and the blade of the second arm on the blade of the third arm, and so on, while, at the same time, allowing them to be separated by actuating the corresponding levers of the clip against the force of the spring.

In the case of a three-arm clip, a first and a second blade serve to fix the end of the lock of hair and allow the lock to be held while rolling it up, with or without a twist, to form a curl.

The curl thus formed may then be held in place between the second blade and the third blade.

In the case of a clip comprising more than three arms, the end of the lock may first be held as indicated above between the first and second blade, a first curl turn (with or without a twist) may then be fixed between a second and third blade on a portion of the length of the lock, and a curl turn may then be made again on the remaining length of the lock (with the same diameter or a different diameter, in the same direction of rolling or otherwise, with or without a twist) etc. for as long as the length of the lock allows it.

This alternative embodiment makes it possible to roll up a long hair with a variable diameter while, at all times during the rolling-up, keeping the lock of hair in the clip without needing to let go of it and thus performing an easy, technically perfect rolling-up, with very fine separations and with no tension on the hair. A long hair would need to dry for a long time on a roller, whereas it may be dried much more quickly on a clip, which thus leads to a gain in time and energy.

Various forms of blades may be considered, as disclosed in the above-mentioned documents.

The spring which holds the blades of the clip in the contact position may consist of a helical metal elastic wire, wound around the transverse articulation axle, the ends of which extend radially from the axle and come to bear under the arms which the spring is intended to hold in contact in the absence of an action of the lever against the force of the spring.

However, various other embodiments of springs are possible, such as U-shaped components or other elastic means such as open rings, etc.

It should be noted that hair clips of this type are often in contact with moisture and various treatment products. In the case of using a metal component to form the spring, it is advantageous to use a non-corrodible material, preferably a nickel-containing or chromium-containing material, to withstand the effect of moisture and of treatment products.

The arms of the clip may also be made of a metal material providing that they withstand the moisture conditions and the treatment agents used in hairstyling. For reasons of lightness, it may be preferable to use plastic components which combine the required lightness and mechanical strength.

The length, width, thickness and shape of the components constituting the clip, in particular the blades, may be adapted to various circumstances both as regards the opening levers and as regards the blade. Needless to say, this also applies to the choice of materials used and to the colours.

Thus, the blades may be pointed (as represented in FIG. 8 of document GB Patent 1,013,720 A), comprise forks with two or more prongs, include insertion of cross braces, or have toothed edges.

In particular, the part forming the lever may be wider or narrower than the part constituting the blades. It is also possible to incorporate a comb system into each clip or to add one thereto to make the clip easier to use.

The clips of the type in accordance with the invention may be provided with any decoration or additional hairstyling components fixed to the clips to produce specific hairstyling effects.

Thus, a system of grooves or an attachment lining on the inner face of the blades or on a portion between them may thus be provided for a better fixing of the locks of hair.

The first blade and the second blade may also be curved (in the shape of a channel or cornice) in the longitudinal direction, while the other blade(s) are flat.

It is also possible to provide one or more blades, in particular those used for the initial holding of the lock, with protection or a bag or any other equivalent means to ensure additional protection of the end which is often very sensitive.

It is also possible to provide one or more blades with a tab fixed perpendicular to the blade, with which the lock of hair may be guided to a chosen curl diameter, optionally by being tensioned on this tab which is preferably made of a semi-rigid material.

In principle, any system which is fixed or fixable to the clip, the purpose of which is to tension, maintain, guide and wrap the lock of hair in order to make it easier to be rolled up, to keep the curl distant from its axle and to give the curl additional stability, may be considered.

In the order of the possibilities of producing the arms, mention may be made of the possibility of one blade being longer than others and being bent at its end to allow better blocking of the lock of hair.

A length-wise or width-wise system of sliding of the arms to make the clip easier to use and to make the curls easier to install may also be considered.

Similarly, a rod, which may or may not be combined with one of the components providing the gripping function, may be provided to obtain easier handling and rotation.

The clips of the type mentioned may also be provided with an additional fixing system, both in the open position of the various blades relative to each other and in the corresponding closed positions.

The major advantage of a clip comprising at least three arms according to the invention lies in the fact that it is considerably easier for the hairstylist to handle the locks of hair.

The hairstylist can practically carry out the described operation of inserting the clips, without any need to form the curl beforehand with the fingers.

The clip with three or more arms according to the invention thus makes it possible to make curls of different diameters without the system essentially being any more bulky than conventional two-arm clips, and allows a greater freedom in the choice of diameters of the curls formed and their relative arrangement, in particular while avoiding the alignment effects that are virtually inevitable in systems with curlers or rollers.

DETAILED DESCRIPTION OF THE PREFERRED EMBODIMENT

Figure 1:
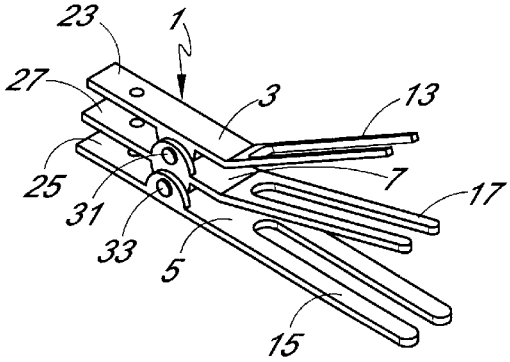
FIG. 1 represents a perspective view of a clip consisting of three arms with the blades spaced apart, this position being achieved by pressing on the two outer levers.

In the various figures, identical reference numbers are used for identical or functionally similar constituent parts.

FIGS. 1 to 5 represent one embodiment in which a first outer arm 3 is articulated relative to a central arm 7, while a second outer arm 5 is articulated relative to this same central arm 7.

In the embodiment represented in FIGS. 1 to 5, the first arm 3 is articulated relative to the central arm 7 on an axle 31 and the second arm 5 , is articulated relative to the same central arm 7 on a second axle 33.

However, there is nothing to prevent the respective articulation of the two outer arms 3 and 5 relative to the central arm 7 from being made on a common axle.

In the embodiment represented in FIG. 1 to 5, reference is also made to the use of two helical springs 35, although other equivalent embodiments for the function performed may also be considered.

Figure 2:
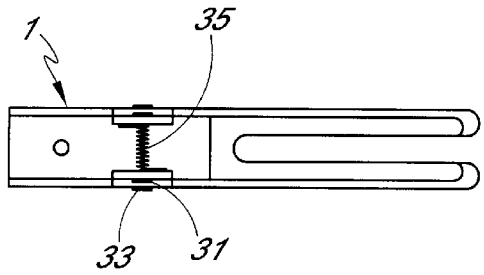
FIG. 2 represents a top plan view of a clip according to FIG. 1 from which the top arm has been removed so that one of the torsion springs can be seen more clearly.
Figure 3:
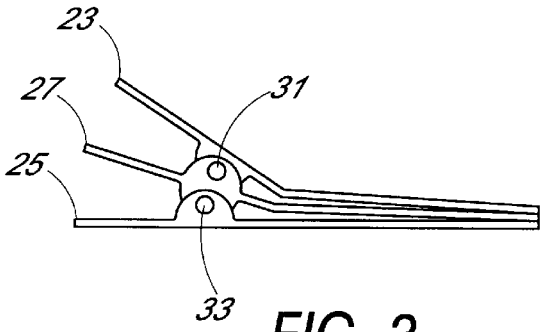
FIG. 3 represents a front plan view of FIG. 1 of this same clip when closed.
Figure 4:
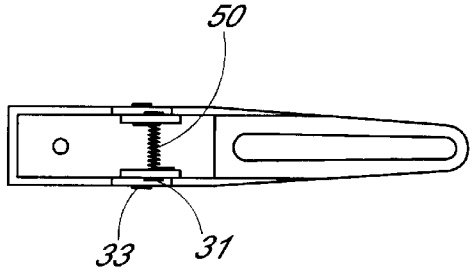
FIG. 4 is a top plan view of FIG. 1 of one possible embodiment in which the blade is shaped into a point.

The outer arm 3 comprises a blade 13 represented in FIG. 1 to 3, without this being limiting in nature, in the form of a two-pronged fork 13. By way of example, FIG. 4 represents a blade of pointed shape. The other end of the first arm 3 consists of a part forming a lever 23.

Similarly, the second outer arm 5 comprises a blade and a lever 25, while the central arm 7 comprises a blade 17 and a lever 27. Blades 15 and 17 have also been represented as being formed by a two-armed fork, but there is no obligation for the blades 15 and 17 to have a configuration identical to that of the blade 13. The blade 17 may, for example, be a flat blade or may be a blade which is narrower than the outer blades 13 and 15, so as to create micro-waves along the length of the lock.

Figure 5:
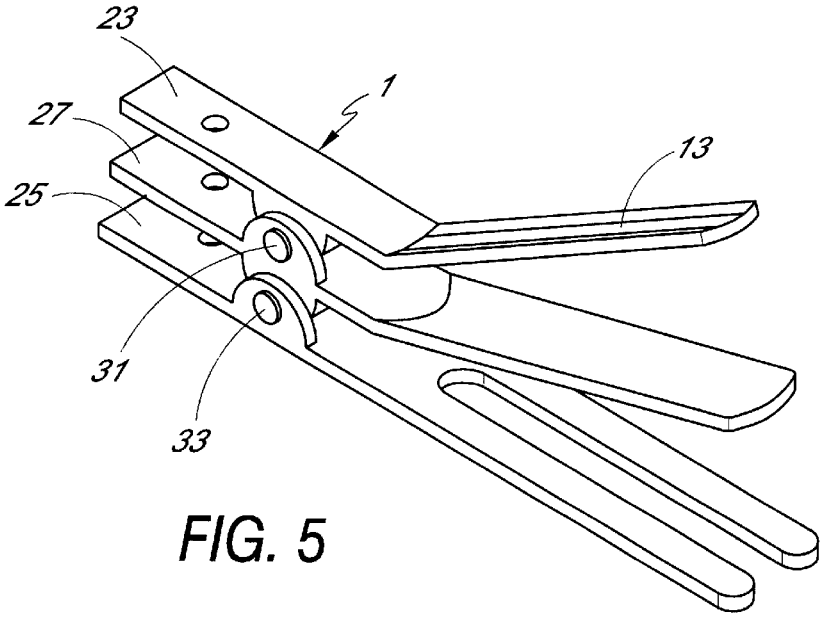
FIG. 5 is a perspective view of an alternative embodiment of three blades, the first two being shaped as cornices of complementary shape and the third being flat.

In the illustration given as an example in FIG. 5, the perspective view of a "cornice-shaped" blade for two blades is shown, the third blade being flat.

Similarly, it may be considered, as shown, for one of the outer blades to be slightly curved (blade 13), while the remaining blades are virtually flat, provided, of course, that a gripping effect between the blades is achieved when closed.

The ends forming the levers 23, 25 and 27 may also come in various shapes.

A spring represented only partially in FIG. 2 with the reference number 35 is made in the form of a helical winding of a wire, the two ends of which are radially spaced apart and end up coming to bear under (that is to say inside) the levers 23 and 27 and 25 and 27, so as to hold the blades in the gripping position represented in FIG. 3.

In the embodiment shown in FIGS. 6 to 11, the articulation axle is virtual.

This embodiment has the advantage of making it possible to produce the clip without mounting the constituent parts on individual axles or on a common axle, thus making it possible to form the entire clip by injection-moulding of a suitable and commonly used plastic material.

In this embodiment (see FIG. 7), the lever 23 is linked to the lever 27 by an arched bridge 41 and the lever 25 is linked to this same lever 27 by an arched bridge 43.

Figure 8:
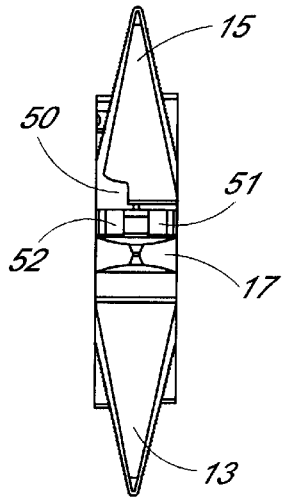
FIG. 8 is a view in the plane perpendicular to that of FIG. 7.
Figure 9:
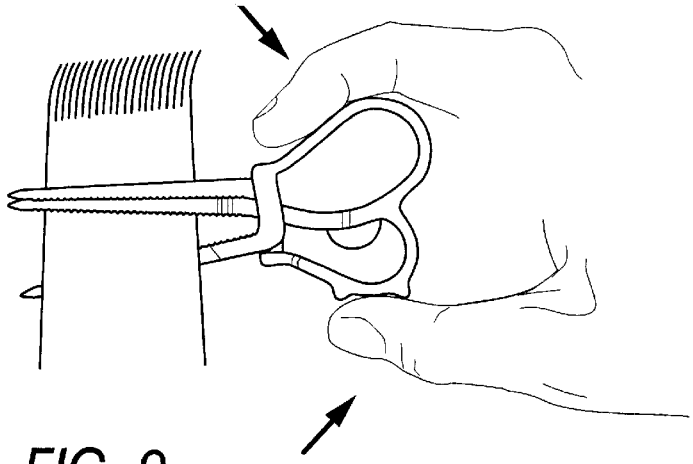
FIG. 9 is a representative profile view of the first phase of the operation related to the invention, namely the gripping of a lock of hair.
Figure 10:
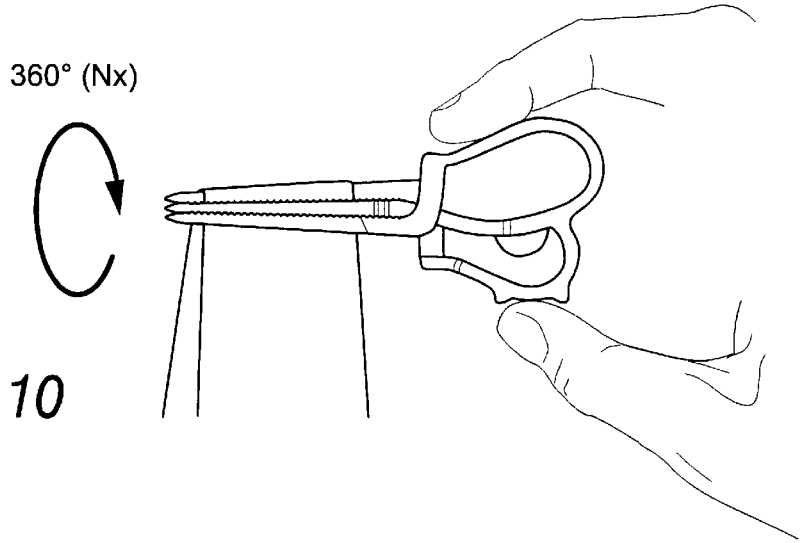
FIG. 10 is a representative profile view of the second phase of the operation related to the invention, namely the turning of the lock.
Figure 11:
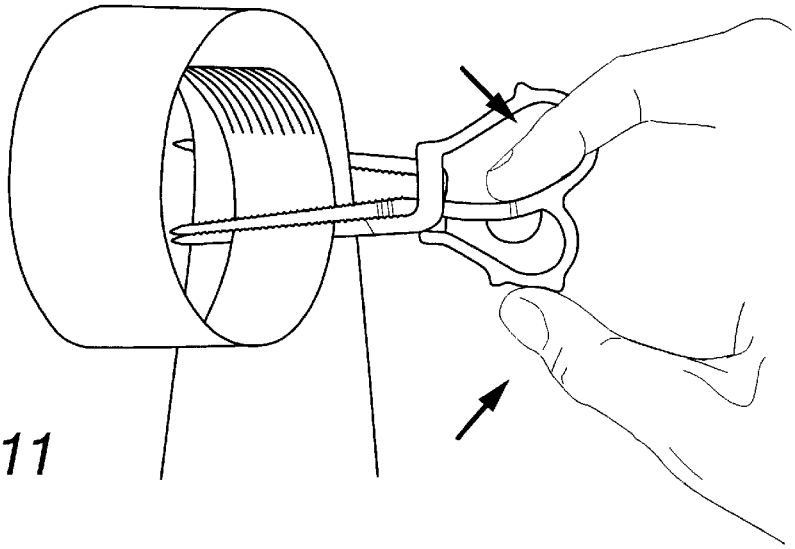
FIG. 11 is a representative profile view of the last phase of the operation related to the invention, namely the gripping of the curl formed by the lock.

Furthermore, the lever 23 is securely fastened to the blade 13 and the lever 25 is securely fastened to the blade 15 respectively by means of blade extensions 13' and 15' which, in the plan view in FIG. 8, each comprise a side notch 49 and 50 towards the central part. Similarly, a blade extension 17' links the central lever 27 to the blade 17, but with side notches 51 and 52 this time on both sides.

The components 13, 13' and 23 thus form the arm 3, the components 15, 15' and 25 form the arm 5 and the components 17, 17' and 27 form the arm 7.

Figure 6:
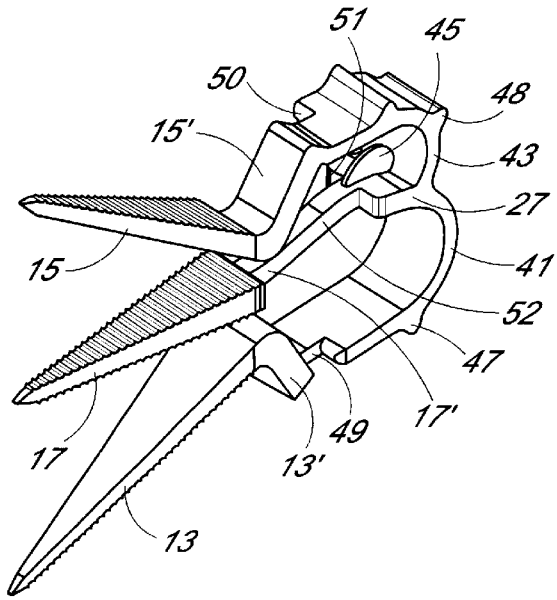
FIG. 6 is a perspective view of one embodiment as may be obtained, in particular by injection-moulding of plastic material, and which requires no mounting on one or more axles, as the movements take place relative to virtual axes.
Figure 7:
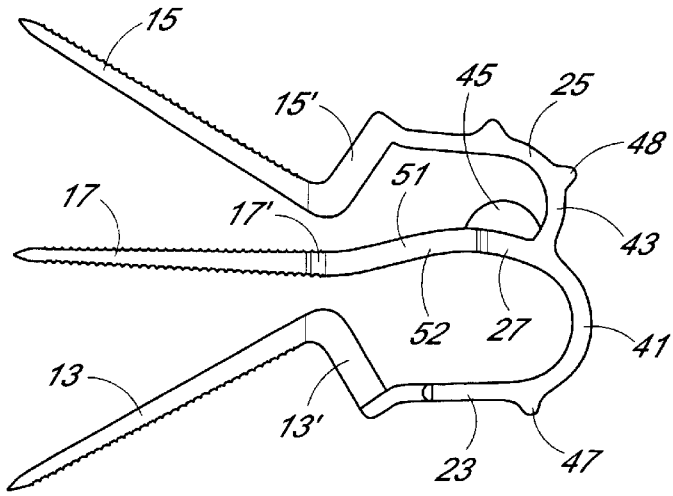
FIG. 7 is a side profile view of the clip of FIG. 6 as obtained after injection-moulding the plastic material of which it is made.

The clip obtained by injection-moulding is initially as represented in FIGS. 6 to 8. It then suffices to house the blade 13 under the central blade 17 and the blade 15 over the central blade 17 by means of a lateral movement, by exploiting the deformability of the bridges 41 and 43 so that the blades 13 and 15 press on the central blade 17. In this position, the bridges 41 and 43 are under flexural stress and maintain the gripping position, in the absence of an external action of the fingers.

By appropriately positioning the thumb of the left hand acting on the lever 25 and the index finger of the same hand acting on the lever 27, the blade 13 is separated from the blade 17, while keeping the blade 15 firmly next to the blade 17. In practice, in order to guide a correct positioning of the fingers better, the bridge 41 is slightly longer than the bridge 43 so as to be able easily to slide the index finger under the lever 23, as shown (with the thumb pressing on the lever 25), to separate the blade 13 from the blade 17.

However, a flange 45 is located in the extension 17' of the blade 17 as represented, so as not to allow the is index finger to slide into the space in which this flange is located.

In order to ensure correct positioning of the index finger on the lever 23 and towards the front of this lever, and also correct positioning of the thumb on the lever 25 at the back of this lever, stops 47 and 48 are provided.

Blade 15 may thus be readily separated from blade 17, while keeping blade 13 firmly next to blade 17.

In all the embodiments, by acting on the levers 23 and 27 and 25 and 27, it is thus possible to successively separate the blades 13 and 17 and the blades 15 and 17.

It now becomes possible first to grip the end of a lock of hair between the blades 13 and 17, to roll the lock of hair into a curl, with or without a twist, by handling the lock of hair by means of the clip, and then to hold the lock of hair in a curled position by gripping the curled lock close to the scalp between the blades 15 and 17.

When all the locks have been rolled up, it is then possible to carry out subsequent treatments on the hair in order to fix it by any suitable means, such as hair setting or permanent-waving with treatment agents that are commonly used for this type of operation.

Although the present invention has been described in terms of certain preferred embodiments, other embodiments of the invention including variations in dimensions, configuration and materials will be apparent to those of skill in the art in view of the disclosure herein. In addition, all features discussed in connection with any one embodiment herein can be readily adapted for use in other embodiments herein. The use of different terms or reference numerals for similar features in different embodiments does not imply differences other than those which may be expressly set forth. Accordingly, the present invention is intended to be described solely by reference to the appended claims, and not limited to the preferred embodiments disclosed herein.

What is claimed is:

1. A clip for hairstyling, comprising:

at least three arms, comprising a central arm, a first outside arm and a second outside arm, wherein each of said arms comprises a gripping part and a first end which serves as a control lever for separating said gripping parts in pairs; and deformable parts connecting said control levers of the arms in pairs, wherein said first outer arm is articulated relative to said central arm and said second outer arm is articulated relative to said central arm by said deformable parts.

2. The hair clip of claim 1, further comprising a first axle and a second axle, wherein said first outside arm is articulated relative to said central arm on said first axle and said second outside arm is articulated relative to said central arm on said second axle.

3. The hair clip of claim 1, further comprising an axle, wherein said first and second outer arms and said central arm are articulated around a common axle.

4. The hair clip of claim 1, further comprising additional hairstyling components fixed to said clip.

5. The hair clip of claim 1, further comprising decoration fixed to said clip.

6. The hair clip of claim 1, wherein said gripping parts comprise blades which comprise grooves on their inner sides for holding locks of hair.

7. The hair clip of claim 1, wherein said gripping parts comprise pointed blades.

8. The hair clip of claim 1, wherein said gripping parts comprise blades which comprise multi-pronged forks.

9. The hair clip of claim 8, wherein said multipronged forks are selected from the group consisting of two pronged forks and three pronged forks.

10. The hair clip of claim 1, wherein said gripping parts comprise blades with cross-braces.

11. The hair clip of claim 1, wherein said gripping parts comprise toothed blades.

12. The hair clip of claim 1, further comprising an additional fixing system.

13. The clip of claim 1, wherein the first outer arm is articulated relative to the central arm on a first virtual axle and wherein the second outer arm is articulated relative to the central arm on a second virtual axle.

* * * * *